US010010469B2

(12) United States Patent
Ladozhskaya-Gapeenko et al.

(10) Patent No.: US 10,010,469 B2
(45) Date of Patent: Jul. 3, 2018

(54) METHOD FOR TREATING AND PREVENTING DISEASES HAVING NEUROLOGICAL, CARDIOLOGICAL AND THERAPEUTIC PROFILES

(71) Applicant: OBCHECTVO S OGRANICHENNOY OTVETSTVENNOSTIY "BELMEDINNOVATSIA", Minsk (BY)

(72) Inventors: Ekaterina Evgenyevna Ladozhskaya-Gapeenko, Sankt-Peterburg (RU); Olga Vladimirovna Fionik, Sankt-Peterburg (RU)

(73) Assignee: OBCHECTVO S OGRANISCHENNOY OTVETSTVENNOSTIY "BELMEDINNOVATSIA", Minsk (BY)

( * ) Notice: Subject to any disclaimer, the term of this patent is extended or adjusted under 35 U.S.C. 154(b) by 0 days.

(21) Appl. No.: 15/103,221

(22) PCT Filed: Dec. 12, 2014

(86) PCT No.: PCT/RU2014/000937
§ 371 (c)(1),
(2) Date: Jun. 9, 2016

(87) PCT Pub. No.: WO2015/088395
PCT Pub. Date: Jun. 18, 2015

(65) Prior Publication Data

US 2016/0354271 A1 Dec. 8, 2016

(30) Foreign Application Priority Data

Dec. 13, 2013 (RU) ..... 2013155494

(51) Int. Cl.
*A61H 1/00* (2006.01)
*A61G 13/02* (2006.01)
(Continued)

(52) U.S. Cl.
CPC ..... *A61H 1/003* (2013.01); *A61G 13/02* (2013.01); *A61H 31/004* (2013.01);
(Continued)

(58) Field of Classification Search
CPC ..... A61H 2203/0493; A61H 1/0229; A61H 1/003; A61H 1/005; A61G 13/009;
(Continued)

(56) References Cited

U.S. PATENT DOCUMENTS 2,808,828 A * 10/1957 Rubin ..... A47C 21/006 5/109
3,434,165 A * 3/1969 Keane ..... A61F 5/3769 5/109
(Continued)

FOREIGN PATENT DOCUMENTS

RU 2128954 C1 4/1999

OTHER PUBLICATIONS

Chen, G. Y., and C. D. Kuo. "The Effect of the Lateral Decubitus Position on Vagal Tone." Anaesthesia 52 (1997): 653-57. Web.*

*Primary Examiner* — Justine Yu
*Assistant Examiner* — Christopher Miller
(74) *Attorney, Agent, or Firm* — Nadya Reingand; Yan Hankin

(57) ABSTRACT

The invention relates to medicine, and more particularly to gravity therapy, and can be used in the comprehensive treatment and rehabilitation of patients having neurological, cardiological and therapeutic profiles with circulatory insufficiency. The technical result is achieved in that the patient is placed in a right lateral recumbent position on an inversion
(Continued)

table with their legs bent at the knees and the thighs spread at 30-60 degrees. The patient is secured by the pelvis with the aid of a soft securing device. The parameters of a cycle of oscillatory movements to be performed by the inversion table as the head part of the table is lowered or raised, i.e. variable angles of rotation about the longitudinal and transverse axes of the table, the oscillation frequency of the table and the maximum angle of inclination of the head part of the table, are set using an operating console. When in operation, the inversion table performs oscillatory movements changing the direction of rotation of the table about the axis and the angle of inclination of the table, the head part of the table being gradually lowered and returned to its starting position. Use of the claimed invention increases the efficacy of treatment of patient diseases related to circulatory insufficiency while avoiding negative effects on the patient in the form of reflex reactions, raised arterial pressure and the disruption of venous outflow from the vital organs.

3 Claims, 6 Drawing Sheets

(51) Int. Cl.
*A61H 31/00* (2006.01)
*A61G 13/00* (2006.01)
*A61G 13/04* (2006.01)

(52) U.S. Cl.
CPC ..... *A61G 13/009* (2013.01); *A61G 13/04* (2013.01); *A61H 2201/1671* (2013.01); *A61H 2203/0475* (2013.01); *A61H 2203/0493* (2013.01); *A61H 2209/00* (2013.01); *A61H 2230/045* (2013.01)

(58) Field of Classification Search
CPC ..... A61G 7/0755; A61G 7/1096; A61G 13/1245; A61G 7/005; A61G 7/008; A47C 20/021; A63B 2208/0266
USPC ..... 434/126, 300, 302
See application file for complete search history.

(56) References Cited

U.S. PATENT DOCUMENTS 3,654,918 A * 4/1972 Blok ..... A61H 1/003 601/98
3,765,406 A * 10/1973 Toole ..... A61B 5/0215 601/26
4,144,880 A * 3/1979 Daniels ..... A61H 1/0222 606/242
4,175,550 A * 11/1979 Leininger ..... 5/109
4,194,499 A * 3/1980 Donnelly, Jr. ..... A61H 1/003 5/610
5,125,123 A * 6/1992 Engle ..... A47C 20/025 128/845
5,134,739 A * 8/1992 Gaffe ..... A61G 7/0755 5/624
5,171,260 A * 12/1992 McIlwain ..... A61H 1/0274 606/243
5,289,828 A * 3/1994 Toth ..... A47C 20/021 128/DIG. 20
5,301,661 A * 4/1994 Lloyd ..... A47C 21/006 601/100
5,320,641 A * 6/1994 Riddle ..... A61H 1/0292 5/618
5,782,869 A * 7/1998 Berdut ..... A61H 1/02 5/609
5,895,366 A * 4/1999 Bzoch ..... A61F 5/012 128/845
6,032,669 A * 3/2000 Klein ..... A47C 20/021 128/845
6,154,905 A * 12/2000 Frydman ..... A47C 20/021 128/845
6,349,437 B1 * 2/2002 Horning ..... A47C 20/023 5/632
6,935,697 B2 * 8/2005 Conlon ..... A47C 16/02 297/423.41
7,111,346 B2 * 9/2006 Inman ..... A61H 1/0218 5/109
8,167,907 B2 * 5/2012 Pruett ..... A61G 13/009 601/26
2003/0046767 A1 * 3/2003 Roston ..... A47C 20/021 5/648
2003/0135137 A1 * 7/2003 Splane, Jr. ..... A61G 13/009 601/24
2004/0011779 A1 * 1/2004 Krywiczanin ..... A61G 7/001 219/217
2005/0222523 A1 * 10/2005 Splane, Jr. ..... A61H 1/001 601/5
2008/0082027 A1 * 4/2008 Phillips ..... A61H 1/003 601/5
2008/0214972 A1 * 9/2008 Phillips ..... A61H 1/003 601/24
2008/0222812 A1 * 9/2008 Phillips ..... A61H 1/0229 5/610
2008/0249437 A1 * 10/2008 Phillips ..... A61H 1/003 601/26
2008/0252116 A1 * 10/2008 Phillips ..... A61H 1/003 297/217.1
2008/0306563 A1 * 12/2008 Kullok ..... A61H 1/0218 607/17
2010/0063427 A1 * 3/2010 Ingrao ..... A61H 1/003 601/90
2010/0313897 A1 12/2010 Schaeffer
2011/0078859 A1 * 4/2011 North ..... A47C 20/027 5/632
2011/0094031 A1 * 4/2011 Tesar ..... A61G 7/005 5/608
2011/0132377 A1 * 6/2011 Phillips ..... A61H 9/0078 128/845
2011/0219544 A1 * 9/2011 Johnston ..... A61G 7/008 5/609
2012/0109027 A1 * 5/2012 Gozelski, Jr. ..... A61G 7/005 601/26
2012/0186020 A1 * 7/2012 Malakhov ..... A61G 7/07 5/623
2014/0109316 A1 * 4/2014 Jackson ..... A61G 13/0036 5/601
2015/0320635 A1 * 11/2015 Viscomi ..... A61H 1/003 601/115

* cited by examiner

METHOD FOR TREATING AND PREVENTING DISEASES HAVING NEUROLOGICAL, CARDIOLOGICAL AND THERAPEUTIC PROFILES

CROSS REFERENCE TO RELATED APPLICATIONS

The present application is a National stage application, from the PCT application PCT/RU2014/000937 filed Dec. 12, 2014, which claims priority to Russian application RU22013155494 filed on Dec. 13, 2013.

FIELD OF THE INVENTION

This invention relates to medicine, and more particularly to gravity therapy, and can be used in the comprehensive treatment and rehabilitation of patients having neurological, cardiological and therapeutic profiles with circulatory insufficiency.

BACKGROUND OF THE INVENTION

The Circulatory system diseases have become one of the most urgent problems of scientific medicine and practical healthcare in the 2nd half of the 20th century and the beginning of the 21st century. They are the leading cause of death in the most economically developed world nations, including Russia. In our country, circulatory system diseases are also the leading cause of human disability and death. If coronary arteries are affected, it may result in angina pectoris, myocardial infarction or sudden cardiac death. The problem of myocardial infarction in recent years has been compounded by the fact that, on the one hand, social stress clearly started to play an increased role in its occurrence, and, on the other hand, the share of middle-aged and older population—most prone to the develop cardiovascular diseases—is progressively growing. This occurs despite the fact that modern doctors have access to a huge arsenal of drugs developed to improve brain and coronary blood flow (antihypertensives, statins, antiaggregants, anticoagulants, angioprotectors, antioxidants, etc.). A cardiovascular disease (affecting the heart or the brain) results in a microcirculatory bloodstream malfunction leading to the death of large areas of tissue (infarction) in these organs with a subsequent decrease or a complete loss of their function, which, in turn, may result in death.

It is known that the force of gravity significantly affects blood circulation. Numerous data indicate that a change in the body position in space relative to the gravity vector leads to functional changes affecting primarily the circulatory and the respiratory systems (Breslav I. S, Glebovskiy V. D., "Regulation of breathing", Leningrad, 1981; Dvoretskiy D. P. "Ventilation, blood circulation and gas exchange in the lungs: Respiratory physiology," St. Petersburg, Nauka, 1994—pages 197-257; Kolchinskaya A. Z. "Hypoxic breathing: Respiratory physiology," St. Petersburg, Nauka 1994—pages 589-619; Safonov V. A., Minyaev V. I., Polunin I. N. "Breathing." Moscow, 2000, page 254).

One known method for application of centrifugal force for therapeutic and restorative rehabilitation of patients with stroke and infantile cerebral palsy, consisting in placing the patients on the smooth surface of a disc, covered with insulated-type flooring and mounted on a trestle scaffold, that may be put into rotation by the drive motor and gear-multiplier. Patients are placed distantly from the center with their head towards the center axis of the apparatus and feet towards the outer radius of the leg that has a foot support. When the apparatus rotates the load initially spreads on the patient's lower limbs under the influence of the centrifugal force rotating the disc, which increases the uniform gradual blood flow into the person's lower and upper limbs, and, at the capillary level, to all organs, blood vessels and cells. The course consists of 10-minute daily sessions combined with physical therapy exercises aimed at training those body parts and limbs that have been long immobilized.

The disadvantage of this method is that when a person is rotated in such position the bloodstream tends to spread more to the lower limbs, which does not give the desired effect in the treatment of patients with consequences of ischemic stroke, cerebrovascular basilar insufficiency, cervical and lumbar spine osteoarthritis, coronary heart disease.

Another known method for treating mild forms of hypertension consists in inducing graduated muscular contractions while the person is being additionally exposed to centrifugal forces in the "head-lower limbs" direction, carried out depending on the stage of the disease: with Hypertension Stage 1 the procedure is performed on a daily basis once a day, gradually increasing the duration of treatment from 6 min. for the first to 12 minutes. for the third procedure, with the rotational speed from 30 to 36 rev/min., the power of dynamic work performed by the lower limbs is brought up from 20 to 100 watts, then such mode of operation is followed until the end of the treatment course, consisting of 10-12 sessions; with Hypertension Stage 2 hypergravity treatment procedure is performed twice a day with a 5-6 hour interval between the sessions, by the third session the duration of the procedure is increased from 5 to 10 minutes, the rotational speed from 25 to 33 rev./min, the power of dynamic work—from 20 to 80 watts.

This method is used for patients with a mild form of hypertension. The disadvantage of this method is that under the influence of the centrifugal force blood moves through main blood vessels towards the pelvis and lower limbs.

Another known method for diagnosis, treatment and prevention of vascular disease of the brain and body tissues is the orthostatic method, accepted as the prototype (Rozlomiy L. K. "The Art of Healing", published at http://www.x-liby.ru/zdorove/iskusstvo_vrachevanija/p12.php) consists in that the patient is placed on a special table having a triangle as the base on top of which a flat surface with soft and voluminous upholstery is mounted and secured, that can change the angle of the work surface relative to the fixed triangular base by alternately raising and lowering the head part of the table. The table is equipped with a strap, which together with the table's soft upholstery does not allow the patient to slide on the surface when it's reclining. The patient lies down on the table fixed in a neutral position with the head and foot ends of the table at the same level and its surface horizontal. Having secured the patient's body with the belt, the head end of the table is lowered at a certain speed down to an angle of 5 to 30 degrees. After holding table in the extreme position for about 10 seconds, the head end is raised to the horizontal level and further up to the same angle as above. The time of keeping the head end of the table in the upper position may be equal to the time of keeping it in the lower position, or longer. After having had alternated these motions for a certain determined time, the procedure is completed with the head end of the table held up in the top position.

The disadvantage of this method is that the static gravitational impact on the upper half of the body causes a reflex response in the form of increased arterial pressure and violation of the venous outflow from the vital organs. This treatment causes no improvement in the microcirculation of the brain, heart and lungs, and there is a serious blood flow to the skin.

SUMMARY OF THE INVENTION

A patient is placed in a right lateral recumbent position on an inversion table with their legs bent at the knees and the thighs spread at 30-60 degrees. The patient may be secured by the pelvis with the aid of a soft securing device. During the procedure the head part of the inversion table makes continuous oscillatory movements with a variable angle of rotation around the longitudinal and transverse axes of the table with a frequency equal or close to the patient's vasomotion frequency. Such caused variations are repeated until the angle of inclination of the inversion table reaches a predetermined value, for example, 45 degrees, after which the unit returns to the horizontal position, while continuing to make the same movements in the process of return. The parameters of a cycle of oscillatory movements are set using an operating console. By regularly treating the patient with the vibration at the frequency close to their vasomotion frequency, the non-functioning or reserve small vessels are being imposed a defined flow rhythm. As a result, the number of functioning capillaries in the organs of the upper body increases and the tissue tropism improves. This prevents the development of undesired reflexes such as vasospasm.

Placing the patient in a right lateral recumbent position with legs bent at the knees and the thighs spread at 30-60 degrees reduces stress on the heart and facilitates the movement of the contents of the stomach into the duodenum. Such position of the patient on the table, on one hand, prevents a sharp outflow of blood during reclines, and on the other—improves blood flow due to the fact that the spreading angle at the hip joints corresponds to the angle of bifurcation of the aorta.

DETAILED DESCRIPTION OF THE PREFERRED EMBODIMENT

The technical result of the claimed invention is the increase in the efficacy of treatment of patients with deficiency of blood circulation and the elimination of the shortcomings of the existing methods available.

Figure 2B:
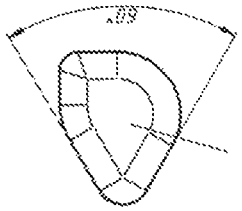
FIG. 2B shows a device for spreading the patient's thighs.
Figure 2A:
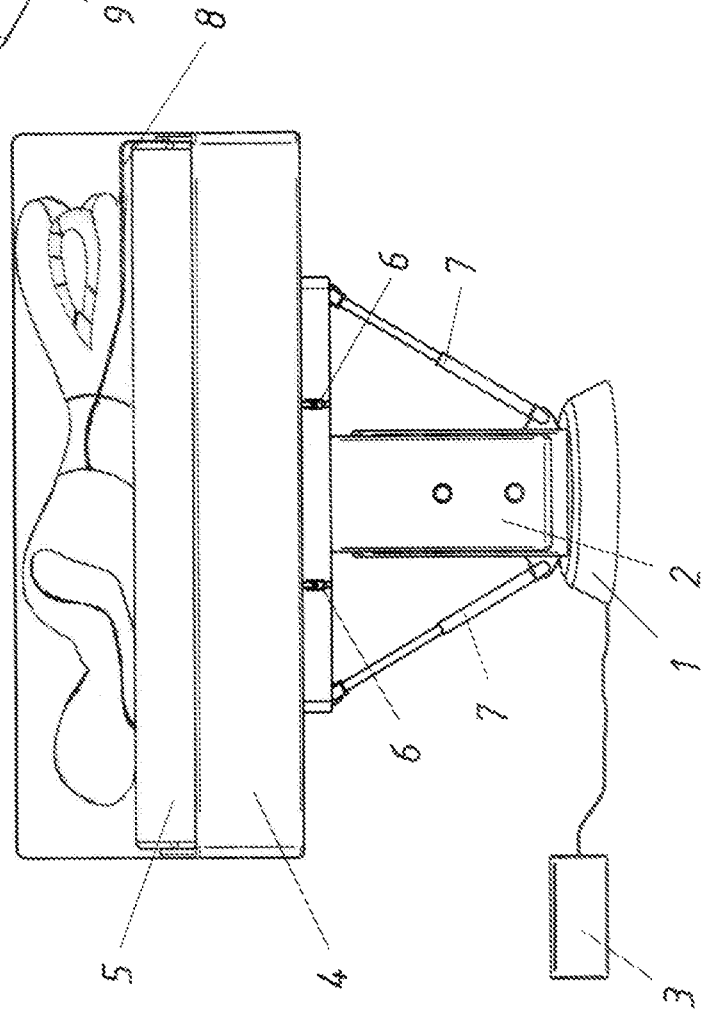
FIG. 2A shows the inversion table with the patient placed in a right lateral recumbent position on the inversion table.
Figure 6:
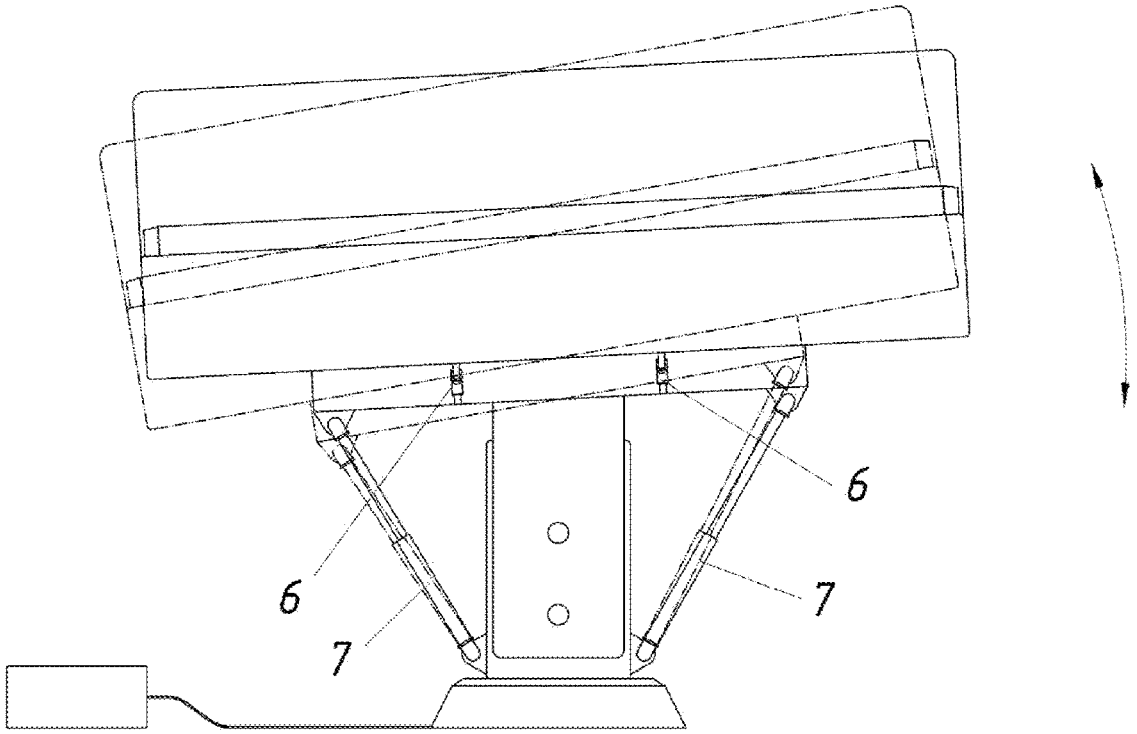
FIG. 6 shows the inversion table carrying out continuous oscillatory movements with a variable angle of rotation around a transverse axis.

This technical result is achieved by the method of treating the patient with the use of an inversion table. As FIG. 2A shows, the patient is placed in a right lateral recumbent position on an inversion table with their legs bent at the knees and the thighs spread at 30-60 degrees. The patient may be secured by the pelvis with the aid of a soft securing device. During the procedure the head part of the inversion table makes continuous oscillatory movements with a variable angle of rotation around the longitudinal (FIGS. 4A-4B and FIGS. 5A-5B) and transverse (FIG. 6) axes of the table with a frequency equal or close to the patient's vasomotion frequency, for example, deflects by 3 degrees down followed by a return 1.5 degrees upward. Such variations are repeated until the angle of inclination of the inversion table reaches a predetermined value, for example, 45 degrees, after which the unit returns to the horizontal position, while continuing making the same movements in the process of return. The parameters of a cycle of oscillatory movements are set using an operating console. By regularly affecting the patient with the vibration at the frequency close to their vasomotion frequency, the non-functioning or reserve small vessels are being "imposed" a defined flow rhythm. As a result, the number of functioning capillaries in the organs of the upper body increases and the tissue tropism improves. This prevents the development of undesired reflexes such as vasospasm.

Placing the patient in a right lateral recumbent position with legs bent at the knees and the thighs spread at 30-60 degrees reduces stress on the heart and facilitates the movement of the contents of the stomach contents into the duodenum. Such position of the patient on the table, on one hand, prevents a sharp outflow of blood during reclines, and on the other—improves blood flow due to the fact that the spreading angle at the hip joints corresponds to the angle of bifurcation of the aorta.

Securing the patient to the table by the pelvis ensures that the traction of the spine when the table is moving downward is soft and proportional to the mass of the patient, the which improves the tropism of the intervertebral discs and reduces the compression of spinal nerve roots. In addition, regular change of the inclination angle of the table promotes abdominal decompression, improving lymphatic drainage, stimulation of the vestibular system, lowering blood pressure, lengthening of the exhalation phase and improving the pulmonary microcirculation.

Soft return to the starting position prevents the formation of undesirable postural reactions.

Figures 1A, 1B:
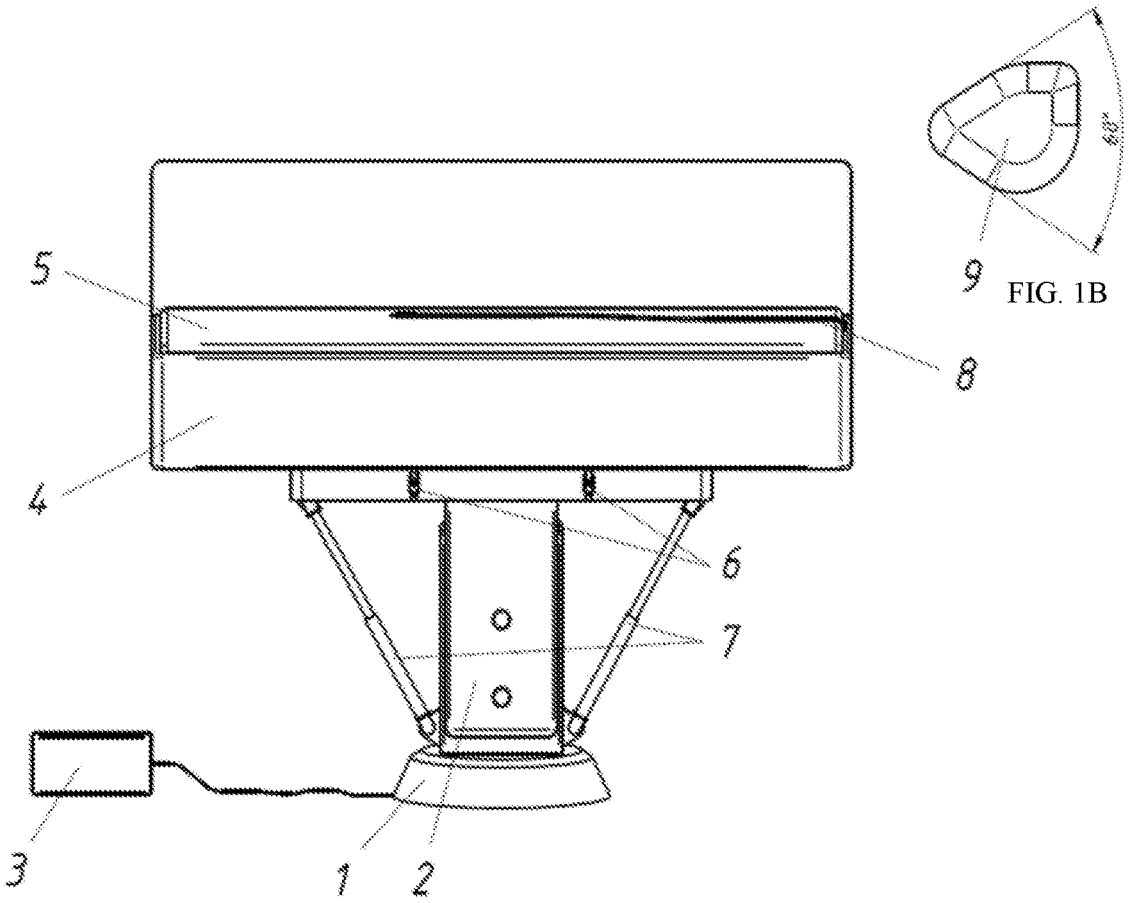
FIG. 1A shows a general view of the inversion table in a starting position.
FIG. 1B shows a device for spreading the patient's thighs.

Gravity treatment procedures may be performed using an inversion table of the following construction (FIG. 1A). The inversion table consists of the support element 1; two engines 2 with drives located, as an option, inside the support element 1; control unit 3; tabletop 4 with side boards fixed to the metal support frame by hinges; hydro-cylinders (pneumatic cylinders or electro-mechanical devices may also be used as a servomechanism) 6 and 7, inclining the tabletop gradually, by steps, in one direction or another to a particular angle. The inversion table also has a mattress 5 with metal buttons for fixing it to the tabletop 4 and fasteners 8 placed on the patient's waist and thighs, and the device 9 for spreading the patient's thighs. The device 9 for spreading the patient's thighs may be of a different shape and configuration, must perform spreading thighs to an angle of 30-60 degrees, and can be made of any material safe for the patient.

Implementation of the method. The patient is placed on the inversion table in a right lateral recumbent position with legs bent at the knees and the thighs spread at 30-60 degrees and is secured by the pelvis with the aid of a soft securing device. The parameters of a cycle of oscillatory movements to be performed by the inversion table as the head part of the table is lowered or raised, i.e. variable angles of rotation about the longitudinal and transverse axes of the table, the oscillation frequency of the table and the maximum angle of inclination of the head part of the table, are set using an operating console. When in operation, the inversion table performs oscillatory movements changing the direction of rotation of the table about the axis and the angle of inclination of the table, the head part of the table being gradually lowered and returned to its starting position.

Using the remote control, the operator may set, for example, the following movement cycles of the inversion table:

- the longitudinal axis X down by 3 degrees,
- the longitudinal axis X up by 1.5 degrees,
- the lateral axis Y down to the right by 3 degrees,
- the lateral axis Y up by 3 degrees,
- tabletop 4 returns to the neutral position relative to the longitudinal axis,
- the lateral axis Y down and to the left by 3 degrees,
- the lateral axis Y up and to the right by 3 degrees.

Figure 3A:
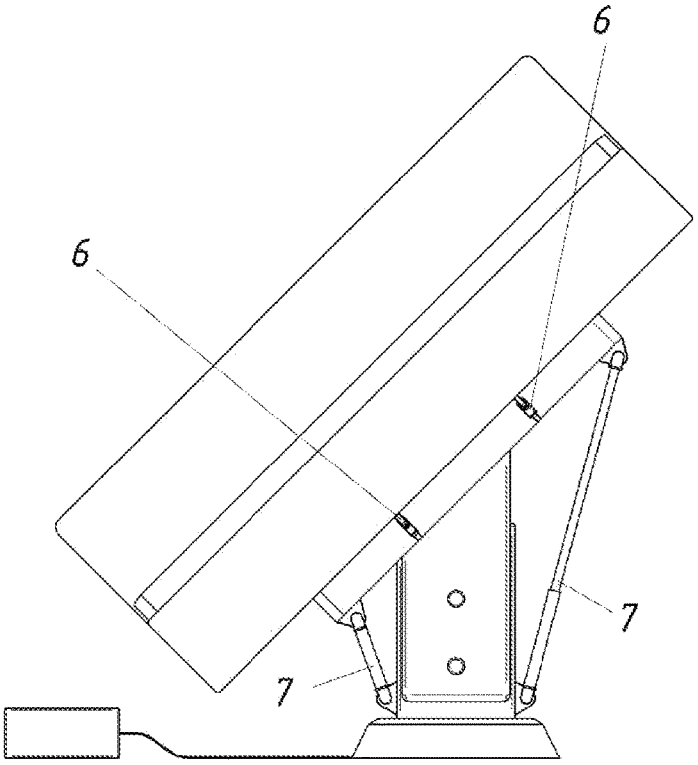
FIG. 3A-3B show the inversion table with the head part lowered to a specified angle.
Figure 3B:
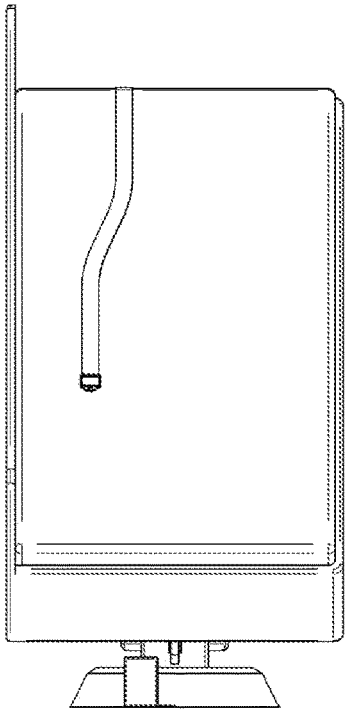
Figure 4A:
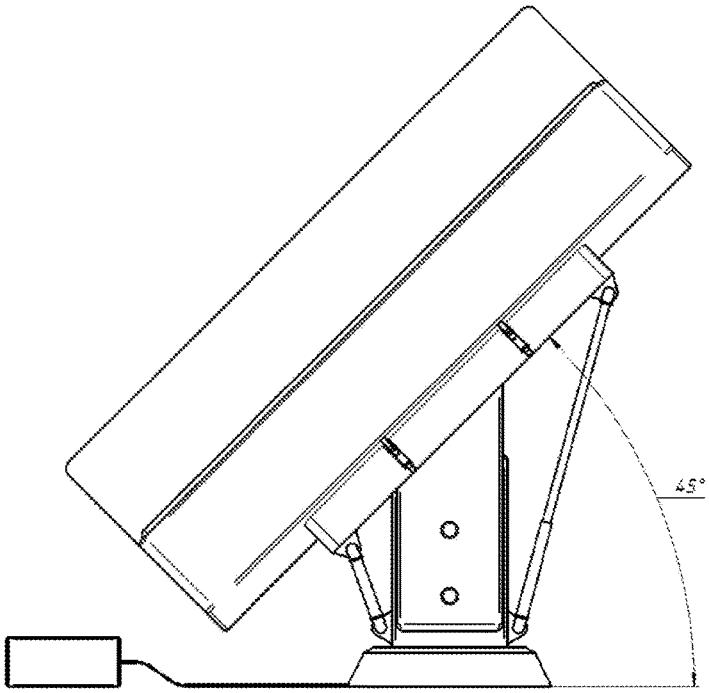
FIGS. 4A-4B and FIG. 5A-5B show the inversion table carrying out continuous oscillatory movements with a variable angle of rotation around a longitudinal axis.
Figure 4B:
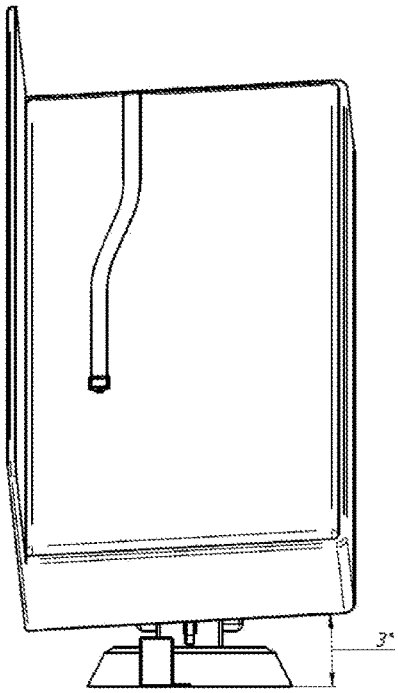
Figure 5A:
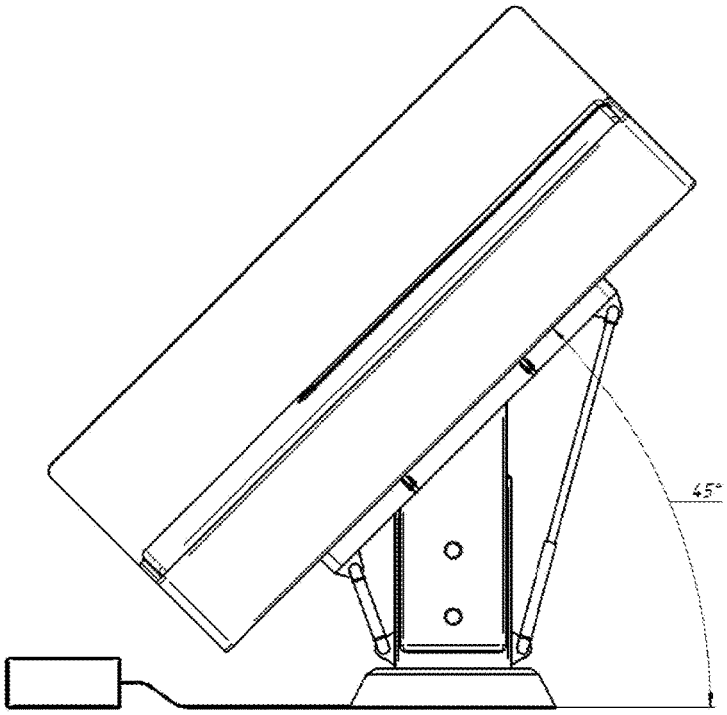
Figure 5B:
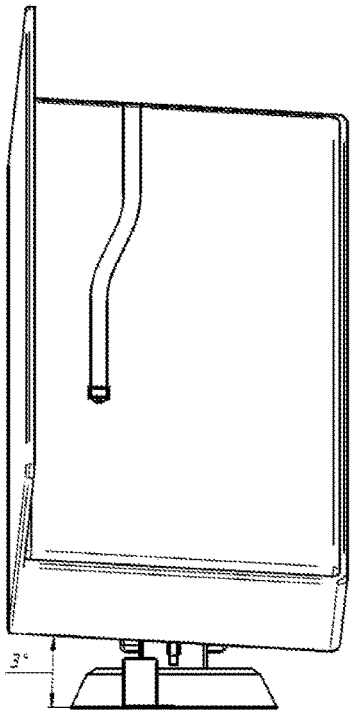

As a result of one movement cycle the tabletop takes the position with the head end inclined 1.5 degrees downward. As shown in FIG. 3A-3B, the device continuously performs the above movements until the head part of the table reaches the inclination angle of 45 degrees, after which it performs the same sequence of movements upward and the tabletop returns to its starting position.

The maximum inclination angle of the upper half of the body may be reduced depending on the initial condition of the patient, followed by its increase to 45 degrees in the process of the treatment cycle.

The therapeutic effect of this method in patients with diseases of the blood circulation system is achieved due to the following factors.

Varying the orientation of the human body in the gravitational field of the Earth is accompanied by the redistribution of the body fluid in accordance with the direction of hydrostatic forces in the vascular system. An important consequence of such movement of the volumes of blood consists in interdependent functional responses of the various physiological systems of the body, the development of which is essentially caused by the change in the general hemodynamic parameters of the cardiovascular system and blood circulation in the individual organs. Inclusion of the angular gravitational effect in the comprehensive treatment and rehabilitation of patients with vascular insufficiency will speed up the process of recovery and adaptation due to the improvement of microcirculation in the upper body organs, enhancement of the lymphatic and venous outflow from the lower body, decompression of the spinal column and the organs of the abdominal cavity. The above described impact will also help avoid excessive blood filling of the vascular bed in the upper half of the body, which is achieved by the features of the claimed invention.

By regularly affecting the patient with the vibration at the frequency close to their vasomotion frequency, the non-functioning or reserve small vessels are being "imposed" a defined flow rhythm. As a result, the number of functioning capillaries in the organs of the upper body increases and the tissue tropism improves. This prevents the development of undesired reflexes such as vasospasm.

Such effects as the improvement of hemomicrocirculation in the upper body organs of the patient, including the brain, heart and lungs, enhancement of the lymphatic and venous outflow from the lower body, decompression of the spinal column and the organs of the abdominal cavity are achieved in the course of one treatment session, which increases the effectiveness of treatment of patients having neurological, cardiological and therapeutic profiles with circulatory insufficiency.

The claimed method cannot be used in patients with acute or life-threatening conditions, during pregnancy, or bleedings of any cause in the early postoperative period.

Implementation of the claimed method is illustrated by the following examples:

Example 1

A 72-year-old man, suffering from coronary heart disease, effort angina, on permanent pharmacotherapy, complaining of shortness of breath when climbing to the second floor. The ECG revealed changes indicative of ischemia. The patient underwent a 10-day course of gravity inversion table therapy, with 30-minute sessions held daily 1 time a day. After a 2-week interval he underwent another 10-day course. As the result of treatment the patient noted an increase in resistance to physical exertion. An electrocardiogram showed a positive tendency as early as after the first session.

Example 2

A 53-year-old woman complained of swelling of the feet manifesting in the evening and pain in the lumbar region. Diagnosis: chronic venous insufficiency of the lower limb veins, chronic lymphovenous insufficiency 3rd degree, concomitant: cervical and lumbar spine osteoarthritis, lumbarization. Laser Doppler velocimetry revealed a stagnant type disturbance of microcirculation, high-amplitude harmonics in the respiratory range, symptoms of neurogenic angiopathy when in a standing position. The patient underwent a 10-day course of gravity inversion table therapy, with 30-minute sessions held daily 1 time a day. Then she was re-examined. The patient subjectively reported an improvement in general well-being, absence of pain in the lumbar region, significant reduction in swelling in the feet. The examination showed normal hemodynamic type of microcirculation in the lower limbs.

Example 3

A 62-year-old man with an Acute Cerebrovascular Event (stroke) of 5 years prior in the medical history. Complained of sleep disorder, memory loss, dizziness, loss of strength in the upper left limb. Sessions were held daily 1 time a day, 30 minutes per session. A course lasted 10 days, in total, the patient underwent 3 gravity therapy courses with an interval of 1 month. The patient noted a significant improvement in general condition, normalization of sleep, improved memory. Neurological examination revealed an increase in strength in the area of the upper and lower left limbs and an improvement of the overall neurological status.

Example 4

A 47-year-old man, diagnosed with chronic bronchitis. Complained of cough with phlegm worsening in the mornings and during exercise. X-ray radiography showed increased pulmonary vascularity. Sessions were held daily 1 time a day, 30 minutes per session. A course lasted 10 days. In total, the patient underwent 2 gravity therapy courses of 10 sessions each with an interval of 2 weeks. After the fifth session the patient noted an increase in phlegm production and cough. At the end of the second course the cough stopped, and the patient reported an improvement in general condition. An X-ray image showed an increase in the transparency of the lung tissue.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is unless specified otherwise, or clear from context, "X employs A or B" is intended to mean any of the natural inclusive permutations. That is, if X employs A; X employs B; or X employs both A and B, then "X employs A or B" is satisfied under any of the foregoing instances, in addition, the articles "a" and "an" as used in this application and the appended claims should generally be construed to mean "one or more" unless specified otherwise or clear from context to be directed to a singular form.

The invention claimed is:

1. A method for treatment and prevention of diseases associated with circulatory insufficiency, comprising:

providing a horizontally arranged inversion table, placing a patient on the horizontally arranged inversion table in a starting position, lowering a head part of the inversion table until a specified angle is reached, and returning the head part of the inversion table to the starting position, wherein the patient is placed on the inversion table in a right lateral recumbent position with legs bent at the knees, thighs of the patient are spread at 30-60 degrees corresponding to an angle of bifurcation of the patient's aorta, wherein the gradual lowering of the head part of the inversion table and the returning to the starting position are carried out by performing a first cycle of continuous oscillatory movements with a first variable angle of rotation around a longitudinal axis, where in the first cycle the head part deflects by 3 degrees down followed by a 1.5 degree return upward, and a second cycle of continuous oscillatory movements with a second variable angle of rotation around a transverse axis of the inversion table, wherein said first and second cycles repeat until the specified angle is reached.

2. The method of claim 1, further comprising securing the patient on the inversion table by the patient's pelvis with the aid of a soft securing device.

3. The method of claim 1, wherein the patient's thighs are spread with a wedge shape device.

* * * * *